United States Patent [19]

Lindskog

[11] 4,185,950

[45] Jan. 29, 1980

[54] SUPPORT ROLLER SCRAPERS FOR WALLBOARD MASTIC APPLYING APPARATUS

[76] Inventor: Eric P. Lindskog, 258 S. Loraine Ave., Glendora, Calif. 91740

[21] Appl. No.: 944,397

[22] Filed: Sep. 21, 1978

[51] Int. Cl.[2] ..... B28B 19/00

[52] U.S. Cl. ..... 425/87; 264/39; 425/225; 425/232

[58] Field of Search ..... 425/87, 225, 232, 458, 425/460, DIG. 36, DIG. 132; 264/39; 172/608, 610, 39, 63

[56] References Cited

U.S. PATENT DOCUMENTS

| | | | |
|---|---|---|---|
| Re. 24,161 | 3/1955 | Rogge et al. | 172/610 |
| 181,832 | 9/1876 | Galt et al. | 172/610 |
| 2,824,442 | 2/1958 | Ames | 425/87 |
| 2,856,767 | 10/1958 | Searl | 425/87 |
| 2,965,926 | 12/1960 | von Haase | 425/225 |
| 2,984,857 | 5/1961 | Ames | 425/87 |
| 3,804,569 | 4/1974 | Walker | 425/225 |
| 3,932,101 | 1/1976 | Johnson | 425/87 |
| 3,975,475 | 8/1976 | Foley | 264/39 |

*Primary Examiner*—Murray Tillman
*Assistant Examiner*—Arthur H. Koeckert
*Attorney, Agent, or Firm*—Victor C. Muller

[57] ABSTRACT

Plaster board mastic applying apparatus comprising a mastic reservoir or casing adapted to be moved along the board having a mastic delivery slot adjacent its trailing end, a trowelling bar disposed rearwardly adjacent thereof, a slideable support at each end of the bar, and a pivoted axis at the leading end of the casing with a roller on each end thereof, the slideable supports and rollers contacting the board to cause the bar to trowel the mastic into a uniform and smooth layer, the uniformity of such layer being interrupted when mastic accumulates on the rollers, and means for periodically removing the accumulation to thereby resume the uniformity of the layer, said means comprising a scraper for each roller secured to the casing in spaced relation thereto during its normal use and engageable therewith during non-use by manually moving the axle about its pivot and rotating a roller by the hand of the operator.

4 Claims, 5 Drawing Figures

SUPPORT ROLLER SCRAPERS FOR WALLBOARD MASTIC APPLYING APPARATUS

BACKGROUND OF THE INVENTION

In the installation of plaster board walls and ceilings it is conventional practice to apply a layer of hardenable mastic across the joint of adjacent wall board panels, employing apparatus as exemplified by various patents to R. G. Ames, U.S. Pat. Nos. 2,824,442 and 2,984,857 being particularly pertinent. Briefly, these patents disclose a tool comprising a mastic housing or reservoir with a discharge slot therein and a trailing trowelling blade which forms a uniform layer of mastic over the joint. The blade is slightly concave and sliding wear shoes adjacent its ends form two supports for the apparatus so that the cross section of the mastic is slightly convex and feathered at the ends of the blade. The "third" support for the apparatus comprises a pivoted axle at the leading end of the apparatus having a roller at each end thereof which rolls on the plaster board. While this is actually a four point support, it is, in effect, a three point support since the axle axis remains parallel to the plaster board surface and is equivalent to placing a single roller thereat.

In the operation of the apparatus, the wear plates and rollers are placed in engagement with the plaster board and pressure is applied by a handle pivotally adjustably connected to a swingable wall or plate which forces mastic through the slot and also moves the apparatus along the plaster board. When the rollers are ahead of the mastic being applied their peripheries remain free of accumulation of mastic. The direction of movement of the apparatus must be reversed, however, when it approaches the end of a joint and the rollers must now move toward the soft mastic layer which has just been applied. During this operation, they often roll over tacky mastic which adheres to their peripheral surfaces. Also, a layer of mastic must sometimes be applied across a previous layer in which event the rollers must move across same, similarly effecting transfer of mastic to their peripheries.

When accumulation of mastic on the rollers occurs, they become eccentric or bumpy, destroying their normal smooth rolling contact with the board, and vibrations are transmitted to the axle axis, which, in turn, are reflected at the trowelling bar, producing transverse lines or other irregularities in the mastic layer. To correct this, the apparatus has been removed from the board and the accumulation removed from the rollers with a finger nail or other scraping implement, entailing loss of time.

SUMMARY OF THE INVENTION

The invention is characterized by a scraper for each of the rollers referred to for periodically removing the mastic from its peripheral surface. Each scraper is normally spaced from its associated roller to permit the roller to freely rotate, as heretofore, and without additional frictional force applied thereto, but which may contact a roller, when desired, by reason of the pivotal mount of the axle. During the scraping operation a portion of the hand of the operator, such as a finger or palm, is engaged with a roller, pivoting the axle and moving the roller into contact with a scraper. A tangential movement across its periphery then rotates the roller into contact with a scraper. Since the length of the hand portion exceeds the circumference of a roller, one movement will rotate a roller in excess of one revolution and normally scrape its entire periphery. This operation is repeated for the other roller after which mastic application to the board is resumed.

One of the objects of the invention, accordingly, and consonant with the foregoing, comprises the provision of scrapers for the supporting rollers of plaster board mastic applying apparatus of the type having a pivoted roller supporting axle, the scrapers being out of contact with the rollers during normal use and engageable therewith only during non-use and as desired by an operator.

Another object is to provide scrapers which may be readily retrofited to existing apparatus as accessories thereto.

Further objects, advantages, and salient features will become more apparent from the detailed description to follow, the appended claims, and the accompanying drawing to now be briefly described.

DETAILED DESCRIPTION OF PREFERRED EMBODIMENT

Figures 1, 2, 3, 4, 5:
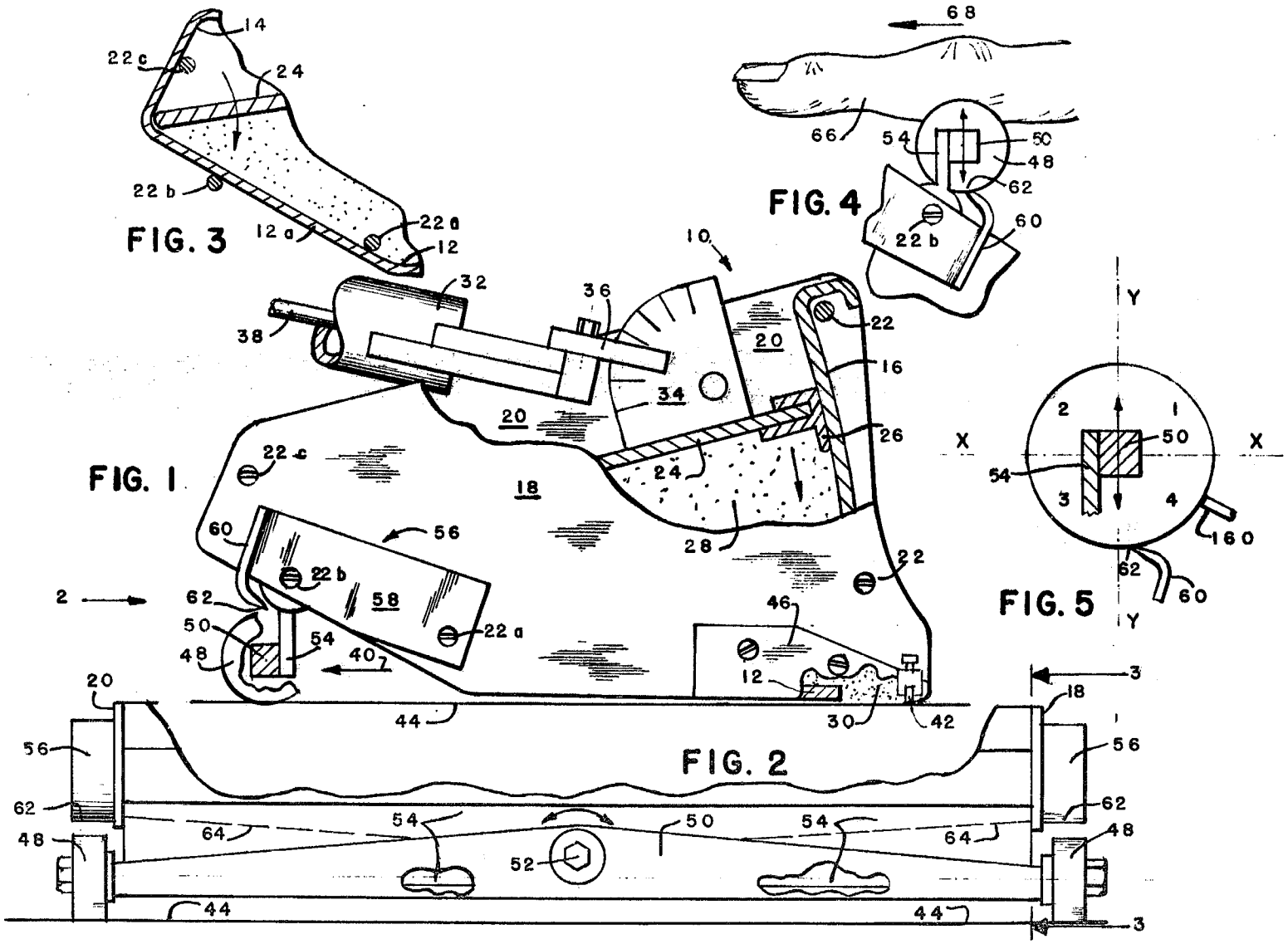
FIG. 1 is a side elevation of the subject of the invention, portions being broken away.
FIG. 2 is a rear elevation as viewed in the direction of arrow 2, FIG. 1.
FIG. 3 is a section taken on line 3—3, FIG. 2.
FIG. 4 is a detail of a roller in engagement with a scraper.
FIG. 5 is a like detail illustrating the operable range of positions of a scraper relative to a roller.

Referring now to the drawing in detail, the conventional apparatus or tool comprises a casing 10 having a bottom wall 12 with an angular portion **12*a* (FIG. 3), a front wall 14, an arcuate rear wall 16 (FIG. 1) and side walls 18,20 secured to the bottom front and rear walls by studs 22 extending between the side walls and other like studs to be subsequently described. A plate 24, having an edge seal 26, pivotally engages the juncture of walls 12*a*, 14 (FIG. 3) and swings adjacent wall 16 and the side walls, thus forming a movable wall or gate for forcing mastic 28 through slot 30 in bottom wall 12, extending between the side walls. A handle 32 is pivotally connected to a quadrant 34, affixed to plate 24, and secured at a desired angular position relative thereto by a lock 36 controlled by a rod 38, extending through the handle to a control lever at its other end (not shown). Pressure on the handle moves the device in the direction of arrow 40 and also forces mastic through slot 30. A transverse trailing bar 42 trowels the mastic to a smooth layer on plaster board 44. The device engages the plaster board by slideable wear plates 46, one at each side of the casing, and a pair of rollers 48,48 rotatably secured to ends of an axle 50 (FIG. 2) secured to the front end of the casing by a pivot 52 and loosely slideable engageable with a flange 54 on the casing. An adjustment on the rear wall 16 of the casing (not shown) distorts trowelling bar 42** to variable concave shape so that the layer of mastic is trowelled to slightly convex shape. U.S. Pat. Nos. 2,824,442 and 2,984,857 disclose adjustments of this type together with various other details which have been omitted in the interests of simplifying the present disclosure.

The feature added to the conventional tool just described comprises roller scrapers 56, affixed to each side wall of the tool, a description of one of which will suffice. Each scraper comprises a flat plate portion 58 with an end portion 60 disposed normal thereto, the end portion terminating in a scraping edge 62 which is normally spaced from its associated roller 48. As illustrated, the scrapers are secured to the side plates 18,20 of the tool by a pair of existing studs *22a,22b* which extend between the side plates. As shown in FIG. 3, stud *22a* is within the casing adjacent bottom wall portion *12a* and stud *22b* is outside of such wall portion. In the attachment of the scrapers to the side walls, these studs are removed and preferably replaced with like studs which are slightly longer than the originals. They may be threaded on both ends to receive nuts or one end may have an integral head. As a retrofit, the accessory kit thus comprises a pair of scrapers (right and left hand) and a pair of longer studs or headed bolts. Alternatively, but not shown, plate portion 58 may be shaped to receive studs *22b, 22c,* rather than studs *22b, 22a.* One stud, *22b,* would also suffice if the scraper is so formed to prevent rotation thereof. If it is desired to affix the scrapers by means other than the studs, this may be attained by headed screws extending through apertures in plate 58 and threadedly engageing end plates 18,20 (not shown).

Referring now to FIG. 2, rollers 48,48 are of right circular cylindrical shape so that they engage the plaster board 44 along a line contact. Since each scraper edge 62 is normally spaced from its associated roller it should be disposed at a slight angle, as illustrated by broken line 64 so that when axle 50 pivotes about pin 52, the entire width of a roller will engage the scraping edge. As will be apparent, if edge 62 were parallel with plaster board 44, it would engage only a corner of a roller, rather than its entire width.

FIG. 4 illustrates an exemplary use of the scrapers wherein the tool has been removed from the plaster board and inverted. A finger 66 (or the palm of the hand) is applied to a roller and moved in the direction of arrow 68. This causes the axle to pivot about its central pin 52 and also pivot slightly about an axis perpendicular thereto, to remove the clearance or looseness, so that the axle slideably engages flange 54 which thus constrains the axis of the roller to movement in a plane parallel to the flange. As illustrated, the edge of the scraper is slightly to the right of such plane. Such plane and the edge of the scraper could thus be considered as a throat into which the periphery of the roller moves and is maintained as the rotating force is applied to its periphery.

The position of the scraper edge, as just described, may be varied within certain limits. In FIG. 5 coordinate axes x—x and y—y have been illustrated to show the four quadrants 1, 2, 3 and 4. Since a roller is normally spaced from a scraper edge and must be moved toward it, when desired, it is apparent that the scraper edge cannot be in quadrants 1 or 2. If in quadrant 3, the throat as previously described, does not exist as such, since the scraper would tend to move the axle away from the flange, rather than toward it. This leaves quadrant 4. As illustrated, the scraping edge is near the beginning of this quadrant, or somewhat in excess of 270° which has been found to be a satisfactory position, but which could be increased somewhat in quadrant 4. It will be apparent that the Y—Y axis and curvature of the roller in this quadrant define a wedge. Also, the clearance between the scraper edge and roller, for a predetermined movement of the axle, is a maximum of 270°. Thus, at 360° with the same clearance the scraper edge would not engage the roller. An intermediate position 160 had been illustrated as a possible practical limit of variation. The disclosure thus contemplates the range of about 270°–315° as the ideal position and a range of about 225°–270° as workable, but not ideal, or a total of 90° within the four quadrants consisting of 360°.

What is claimed is:

1. An apparatus for applying a layer of mastic over plaster board joints of the type having a mastic reservoir for delivering mastic through a slot and a trailing blade adapted to trowel the mastic into a desired layer, the apparatus having a slideable support adjacent each end of the blade and a third support at its leading end, said third support comprising an axle pivoted to the reservoir for movement about an axis substantially parallel to the board, and a roller at each end thereof engageable with the board, whereby the slideable supports and the rollers may move in contact with a warped surface, as permitted by the axle pivot, the improvements, in combination comprising;

(a) a scraper for each roller for removing mastic from the peripheral surface thereof, (b) each scraper being spaced from its associated roller and out of contact therewith during normal movement of the apparatus across the board, (c) each roller being subject to accumulation of mastic on the periphery thereof which effects non-uniform troweling of the mastic, (d) each scraper being spaced from its associated roller, and within the pivotal limit of the axle, such that the axle may be pivoted and engage a roller with a scraper, (e) each scraper also being affixed to the reservoir at a position thereon such that a portion of the roller is accessible to a hand of an operator for rotating same, (f) the construction and arrangement being such that when accumulation of mastic on a roller occurs, the apparatus may be removed from the board and a portion of the hand of the operator moved across and in contact with the roller periphery, moving the axle about its pivot and the roller into rotating contact with the scraper, thereby scraping the accumulation therefrom.

2. Apparatus in accordance with claim 1 wherein said reservoir comprises a pair of end plates secured by bolts extending therebetween, at least one of said bolts also securing a scraper to an end plate.

3. Apparatus in accordance with claim 2 wherein each scraper is secured to an end plate by two of said bolts.

4. Apparatus in accordance with claim 1 wherein each roller is of uniform diameter across its width and each scraper is provided with a scraping edge disposed at a slight angle to the board, whereby the entire periphery of a roller contacts a scraper edge when the axle is pivoted to contact a roller with a scraper edge.

* * * * *